United States Patent [19]

Yorihisa

[11] Patent Number: 4,674,382

[45] Date of Patent: Jun. 23, 1987

[54] ELECTRONIC MUSICAL INSTRUMENT HAVING A TOUCH RESPONSIVE CONTROL FUNCTION

[75] Inventor: Yamaguchi Yorihisa, Hamakita, Japan

[73] Assignee: Nippon Gakki Seizo Kabushiki Kaisha, Hamamtsu, Japan

[21] Appl. No.: 693,688

[22] Filed: Jan. 23, 1985

[30] Foreign Application Priority Data

Jan. 26, 1984 [JP] Japan ..... 59-011067

[51] Int. Cl.[4] ..... G10H 1/00

[52] U.S. Cl. ..... 84/1.01; 84/1.19

[58] Field of Search ..... 84/1.01, 1.03, 1.19, 84/DIG. 4

[56] References Cited

U.S. PATENT DOCUMENTS

| | | | |
|---|---|---|---|
| 4,351,214 | 9/1982 | Suzuki et al. | 84/1.03 |
| 4,450,745 | 5/1984 | Nakada et al. | 84/1.19 |
| 4,450,746 | 5/1984 | Deutsch | 84/DIG. 4 |
| 4,539,884 | 9/1985 | Aoki | 84/1.19 |

FOREIGN PATENT DOCUMENTS 3131981 1/1981 Japan .

*Primary Examiner*—Russell E. Adams

*Attorney, Agent, or Firm*—Spensley, Horn Jubas & Lubitz

[57] ABSTRACT

A keyboard is capable of being used by splitting it in plural key areas at a predetermined split position or positions. A tone forming circuit generates a tone signal corresponding to a depressed key in each key area in a tone generation manner corresponding to one of the split key areas. A plurality of key touch sensors are provided in correspondence to splittable key areas. In case that a certain key split mode is being selected, each touch sensor outputs a touch signal representing a degree of depression of the depressed key in a corresponding key area and supplies it to the tone forming circuit. The tone forming circuit imparts the tone signal for each key area with a touch responsive characteristic in accordance with the corresponding touch signal, thereby performing a properer touch response control in an electronic musical instrument.

15 Claims, 5 Drawing Figures

ELECTRONIC MUSICAL INSTRUMENT HAVING A TOUCH RESPONSIVE CONTROL FUNCTION

BACKGROUND OF THE INVENTION

This invention relates to a touch responsive control in an electronic musical instrument and, more particularly, to an electronic musical instrument which, in generating in a different tone generation manner, a tone corresponding to a key in a single key area consisting of the whole keyboard or a key in one of plural key areas established by splitting the keyboard, is capable of switching a key area split mode in response to a switching operation and, more particularly, to employment of a key touch detection device common to a plurality of keys.

There is known, for example in Japanese Utility Model Publication No. 313/1981, an electronic musical instrument in which a common touch sensor is provided under a plurality of keys arranged in a single line and a tone is controlled by an output of the touch sensor produced by depression of one of the keys. On the other hand, there has been developed and manufactured an electronic musical instrument in which, as disclosed in U.S. Pat. Nos. 4,365,532, 4,450,745 and 4,351,214, a key area split mode can be switched in such a manner that either a single keyboard is divided in two key areas with a higher-pitch key area being used for playing melody and a lower-pitch key area for playing accompaniment or the entire keyboard is used for playing melody.

A problem in this type of electronic musical instrument is that, if the touch response control is performed with the above described touch sensor which is common to all keys, an effective touch detection output cannot be obtained during the key split mode with a result that a proper touch response control cannot be performed.

It is therefore an object of the present invention to provide, in an electronic musical instrument in which the key area split mode is switched by the switching operation, a touch response device capable of effectively utilizing a key touch detection signal for the tone control in accordance with the key area split mode then available.

SUMMARY OF THE INVENTION

An electronic musical instrument according to the invention comprises keyboard means having a key arrangement consisting of a plurality of keys arranged in a single line, splitting means capable of selecting one among one or more key area split modes for splitting the keys into plural key areas at at least one predetermined position corresponding to a selected key area split mode in the key arrangement, tone forming means connected to the keyboard means and the splitting means for forming a tone signal corresponding to a depressed key in a tone generation manner corresponding to the selected key area split mode, touch detection means including a plurality of key touch detection devices which is provided in association with the key areas respectively, and touch signal distribution means for distributing each of the outputs of the key touch detection devices in accordance with the selected key area split mode to supply it to the tone forming means as a tone control signal.

The key touch detection means is not composed of a key touch detection device which is common to all keys but is composed of a plurality of the key touch detection devices which are separated at a predetermined position which has at least possibility of becoming a key split point. The tone forming means generates a tone signal corresponding to the depressed key in a tone generation manner corresponding to the selected key area split mode and also controls the tone signal in response to the output signal of the key touch detection device which has been distributed by the distribution means in accordance with the selected key area split mode. Thus, the plurality of key touch detection devices are used in a functionally split manner in accordance with the selected key area split mode so that an effective touch responsive control is realized.

DESCRIPTION OF PREFERRED EMBODIMENTS

Described below are embodiments of an electronic musical instrument having keyboard 10 on which a plurality of keys is in one row and selectively capable of splitting the keyboard 10 into plural key areas by a switching operation.

Figures 1, 2:
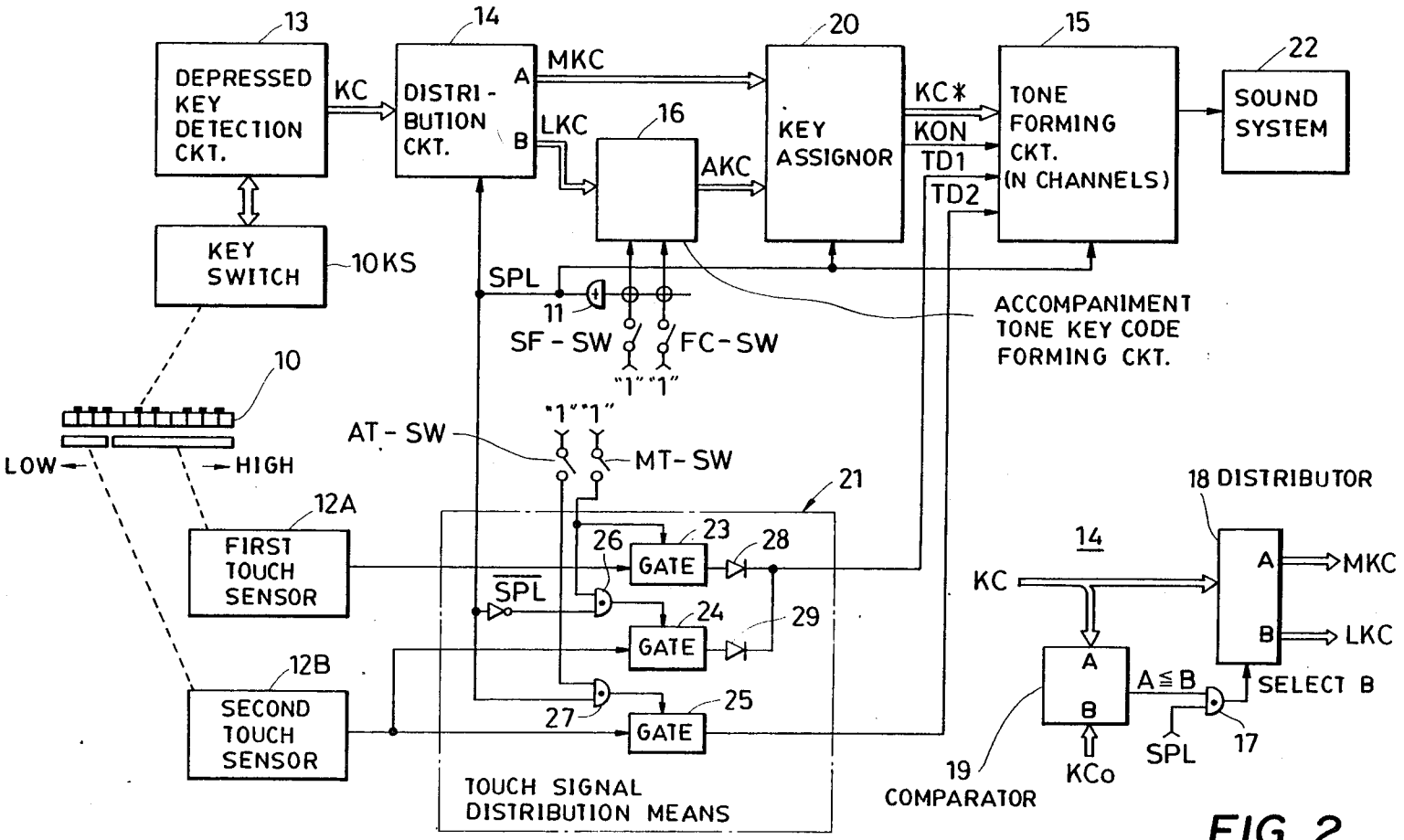
FIG. 1 is an electric block diagram showing an embodiment of the invention.
FIG. 2 is a block diagram showing an example of a distribution circuit.

In the embodiment shown in FIG. 1, the keyboard 10 can be split into two key areas at a predetermined position in the key arrangement. This is enabled by means of a single-finger mode selection switch SF-SW and a fingered chord mode selection switch FC-SW which are originally provided for the automatic bass/chord performance selection. Specifically, when the automatic bass/chord performance in either the single finger mode or fingered chord mode is selected by turning on either the switch SF-SW or FS-SW, the keyboard 10 is split at a predetermined position into the higher-pitch key area and the lower-pitch key area. The higher-pitch key area is used, for instance, for the melody performance and the lower-pitch key area for the accompaniment performance (automatic bass/chord performance). Such a manner that the keyboard 10 is split into plural key areas will be called a split mode below. When both the switches SF-SW and FC-SW are off and thus any automatic bass/chord performance is not selected, the key area split is not effected and the whole area of the keyboard 10 is used for a single tone generation mode such as the melody performance. Such a manner in which the keyboard 10 is not split into plural key areas will be called a normal mode below. It is of course that the key area split modes consist of the split mode and the normal mode. The outputs of the switches SF-SW and FC-SW are applied to an OR gate 11 and used as a split mode signal SPL. When the signal SPL is "1" it indicates the split mode and when "0", the normal mode.

In relation to the individual keys of the keyboard 10 (for instance, beneath an individual key area) there are provided key touch detectors 12A and 12B which detect a key depression speed, a key depression force, a key depression depth, etc. and are split from each other at the predetermined split position. One corresponding to the higher-pitch key area will be called the first touch sensor 12A and the other corresponding to the lower-pitch key area will be called the second touch sensor 12B. The sensor as described in the above-mentioned Japanese Utility Model Publication No. 313/1981 or any other appropriate sensor may be used as the sensors 12A and 12B.

In relation to each key of the keyboard 10, there is provided a key switch 10KS. Responsive to the output of the key switch 10KS, a depressed key detection circuit 13 detects the depression of a key or keys and produces data identifying the depressed key or the key code KC. The distribution circuit 14 leads the depressed key data or the key code KC from the depressed key detection circuit 13 to either the output terminals A or B according to the split mode signal SPL. The depressed key data led to the output terminal A of the distributor circuit 14 will be called the melody key code MKC while the depressed key data led to the output terminal B will be called the lower key area key code LKC. A melody tone signal for a melody performance is formed according to the melody key code MKC by a tone forming circuit 15. Responsive to the key code LKC, meantime, accompaniment tone key code AKC (key code corresponding to a bass tone, a chord tone, etc.) is formed by an accompaniment tone key code forming circuit 16. The tone forming circuit 15 produces an accompaniment tone signal for the accompaniment (automatic bass/chord performance) according to the accompaniment tone key code AKC.

FIG. 2 shows an example of the distribution circuit 14. In the normal mode, the output of an AND gate 17 is "0" because the signal SPL is "0". A distributor 18 controlled by the output of the AND gate 17, therefore, selects the A output so as to lead all the key code KC from the depressed key detection circuit 13 to the output terminal A and deliver it as the melody key code MKC. Thus the whole key area of the keyboard 10 is put in the tone generation manner for the melody performance. In the split mode, the AND gate 17 is enabled by the signal SPL in the "1" state so that the distributor 18 is controlled according to the output of a comparator 19 applied to the other input of the AND gate 17. The comparator 19 compares the key code KC supplied to its A input from the depressed key detection circuit 13 and reference key code $KC_0$ fixedly applied to its B input (corresponding to the key code of the key adjacent to the predetermined split position) and produces a signal 1 when $A \leqq B$ and a signal 0 when $A > B$. Thus in the split mode, distinction is made between the depressed keys on the higher side of the split position (belonging to the higher key area) and those on the lower side of the split position (belonging to the lower key area) so as to lead the key code KC to the output terminal A of the distributor 18 and provide it as the melody key code MKC in response to the depression of a key in the higher key area (i.e., when $A > B$), and lead the key code KC to the output terminal B of the distributor 18 and provide it as the lower key area key code LKC in response to the depression of a key in the lower key area (i.e., when $A \leqq B$).

Reverting to FIG. 1, the accompaniment tone key code forming circuit 16 forms accompaniment tone key code AKC according to the operated manner of the switches SF-SW and FC-SW in the following manner. When the fingered chord mode selection switch FC-SW is on, the lower key area key code LKC applied to the circuit 16 is delivered as it is from the circuit 16 as the accompaniment tone key code AKC for the chord tone. At the same time, the chord is detected based on the applied key code LKC to prepare the key code for the automatic bass tone, which is delivered as the accompaniment tone key code AKC. When the single finger mode selection switch SF-SW is on, the circuit 16 forms a key code for the chord tone and the automatic bass tone based on the applied key code LKC (corresponding to the root note of the chord) and delivers such code as the accompaniment tone key code AKC. The chord type such as major and minor are designated by means of an appropriate switch which is not shown. When both the switches SF-SW and FC-SW are turned on simultaneously, one of them, say SF-SW, for instance, is given priority. When both of these switches are on, the circuit 16 is adapted not to produce any output. The accompaniment tone key code forming circuit 16 can be constructed by utilizing the arrangement of the known automatic bass/chord performance device.

A key assigner 20 is provided to assign the depressed key to available one of a certain number N of tone forming channels and delivers (e.g., in time division) the key code KC* identifying the depressed key and key-on signal KON representing that the depressed key is being depressed for the channel to which the depressed key has been assigned. The tone generation manner of each channel is not fixed but varies according to the key area split mode. The key assignor 20 is supplied with the split mode signal SPL which indicates the key area split mode. By way of example, when the signal SPL is "0", namely in the normal mode, all the N channels are used to assign the melody key code (i.e., for the tone generation manner for the melody performance). When the signal SPL is "1", namely in the split mode, the N channels are split into the group for the melody and the group for the accompaniment, the group for the melody being used to assign the melody key code MKC (i.e., for the tone generation manner for the melody performance) while the group for the accompaniment being used to assign the accompaniment tone key code AKC (i.e., for the tone generation manner for the accompaniment). For instance, when $N=6$, the first and second channels are used to assign the melody key code MKC while the third to sixth channels are used to assign the accompaniment tone key code AKC.

The tone forming circuit 15 comprises N tone forming channels (these channels may be allowed to use a common tone forming means or may be provided with separate tone forming means in parallel) and forms the tone signal based on the key code KC* and the key-on signal supplied from the key assignor 20. More specifically, each of these channels has the pitch corresponding to the key code KC* assigned thereto and forms a tone signal provided with the amplitude envelope responsive to the key-on signal KON. The tone forming circuit 15 is supplied with the split mode signal SPL so that the tone forming in each channel may be effected based on the signal SPL in the tone generation mode corresponding to the key area split mode. The touch responsive control (i.e., variable control of various tone control parameters such as the pitch, tone color, volume and tonal effects according to a touch signal) is effected according to the key area split mode in response to touch signals TD1, TD2 supplied from a touch signal distribution means 21 to be described below. The tone signals formed in the tone forming circuit 15 are applied to a sound system 22 for the production of sound.

The touch signal distribution means 21 selects one of the outputs of the first and second touch sensors 12A and 12B according to the key area split mode selected by the switch SF-SW or FC-SW and supplies the selected output to the tone forming circuit 15 as the touch signal TD1 or TD2. To select independently as to whether to apply the touch control to the melody tone and the accompaniment tone, there are provided a melody tone touch control selection switch MT-SW and an accompaniment tone touch control selection switch AT-SW, of which the outputs, together with the split mode signal SPL (that is, the outputs of the switches SF-SW and FC-SW) control gates 23, 24 and 25. The output of the first touch sensor 12A corresponding to the higher key area is applied to the gate 23 which is controlled by the switch MT-SW. The output of the second touch sensor 12B corresponding to the lower key area is applied to the gate 24 which is controlled by the output signal of an AND gate 26 which ANDs the inverted signal $\overline{SPL}$ of the split mode signal SPL and the output of the switch MT-SW. Similarly, the output of the second touch sensor 12B is applied to the gate 25 which is controlled by the output signal of an AND gate 27 which ANDs the split mode signal SPL and the output of the switch AT-SW. The outputs of the gates 23 and 24 are applied to diodes 28 and 29 respectively before being mixed to each other and then supplied to the tone forming circuit 15 as the touch signal TD1. The diodes 28 and 29 cause one of the outputs of the gates 23 and 24 which is at a higher level than the other to be delivered. The output of the gate 25 is applied to the tone forming circuit 15 as the touch signal TD2.

When the touch control is to be applied to both the melody tone and the accompaniment tone, the switches MT-SW and AT-SW are both on and producing "1" so that AND gates 23, 26 and 27 are enabled. Therefore, the output of the touch sensor corresponding to the higher key area passes the gate 23 at all times and is delivered as the touch signal TD1. When the split mode signal SPL is "0", that is, when in the normal mode, the signal $\overline{SPL}$ is "1" so that the output signal of the AND gate 26 is "1" and the gate 24 is enabled. At this time, the output of the AND gate 27 is "0" since the signal SPL is "0" and thus the gae 25 is not enabled. When the split mode signal SPL is "1", that is, when in the split mode, the output signal of the AND gate 27 is "1" so that the gate 25 is enabled while the gate 24 is not enabled due to the output signal "0" of the AND gate 26.

The distribution manner of the touch signals in accordance with the key area split mode will now be summarized. First, in the normal mode, one of the outputs of the first touch sensor 12A and the second touch sensor 12B through the gates 23 and 24 is selected and delivered as the touch signal TD1. In this case, the touch signal TD2 is not generated. Next, in the split mode, the output of the first touch sensor 12A through the gate 23 is delivered as the touch signal TD1 while the output of the second touch sensor 12B through the gate 25 is delivered as the touch signal TD2. In the tone forming circuit 15, the touch signal TD1 is used for the touch responsive control of the melody tone while touch signal TD2 is used for the touch response control of the accompaniment tone. Accordingly, in the normal mode where the tones in the whole key area are formed in the tone generation manner for the melody performance, the outputs of the touch sensors 12A and 12B corresponding to the whole key area are selected and delivered as the touch signal TD1 for the melody tone, whereas in the split mode where the tone generation manner is different between the higher key area and the lower key area, the outputs of the touch sensors 12A and 12B corresponding to the key areas to which the depressed keys belong are selected and delivered separately.

Where the touch response control is not to be effected on the melody tone or on the accompaniment tone, the corresponding switch MT-SW or AT-SW is turned off, thereby prohibiting the generation of the touch signal TD1 or TD2. Provision of these switches MT-SW and AT-SW is not essential but the touch responsive control may be turned on or off by means of a single switch. Alternatively, the touch responsive control may be applied at all times, thus dispensing with such switch or switches. The outputs of the gates 23 and 24 may be mixed not only by using the diodes 28 and 29 but also in any other appropriate manner. For instance, the circuit calculating the average of both outputs may be provided.

In the tone forming circuit 15, when the split mode signal SPL is "0", that is, when in the normal mode, the tone signals are formed in all the channels in the tone generation manner for the melody performance (i.e., with tone colors selected for the melody performance) while effecting the touch responsive control according to the touch signal TD1 for the melody tone. When the split mode signal SPL is "1" that is, when in the split mode, the tone signals are formed in different modes between the melody channel group (e.g., the first and second channels) and the accompaniment channel group (e.g., the third to sixth channels). Specifically, in the melody channel group, the tone signals are formed in the tone generation manner for the melody performance while effecting the touch response signal according to the touch signal TD1. In the accompaniment channel group, the tone signals are formed in the tone generation manner for the accompaniment (i.e., with the tone color selected for the accompaniment) while effecting the touch responsive control according to the touch signal TD2 for the accompaniment tone.

Figure 3:
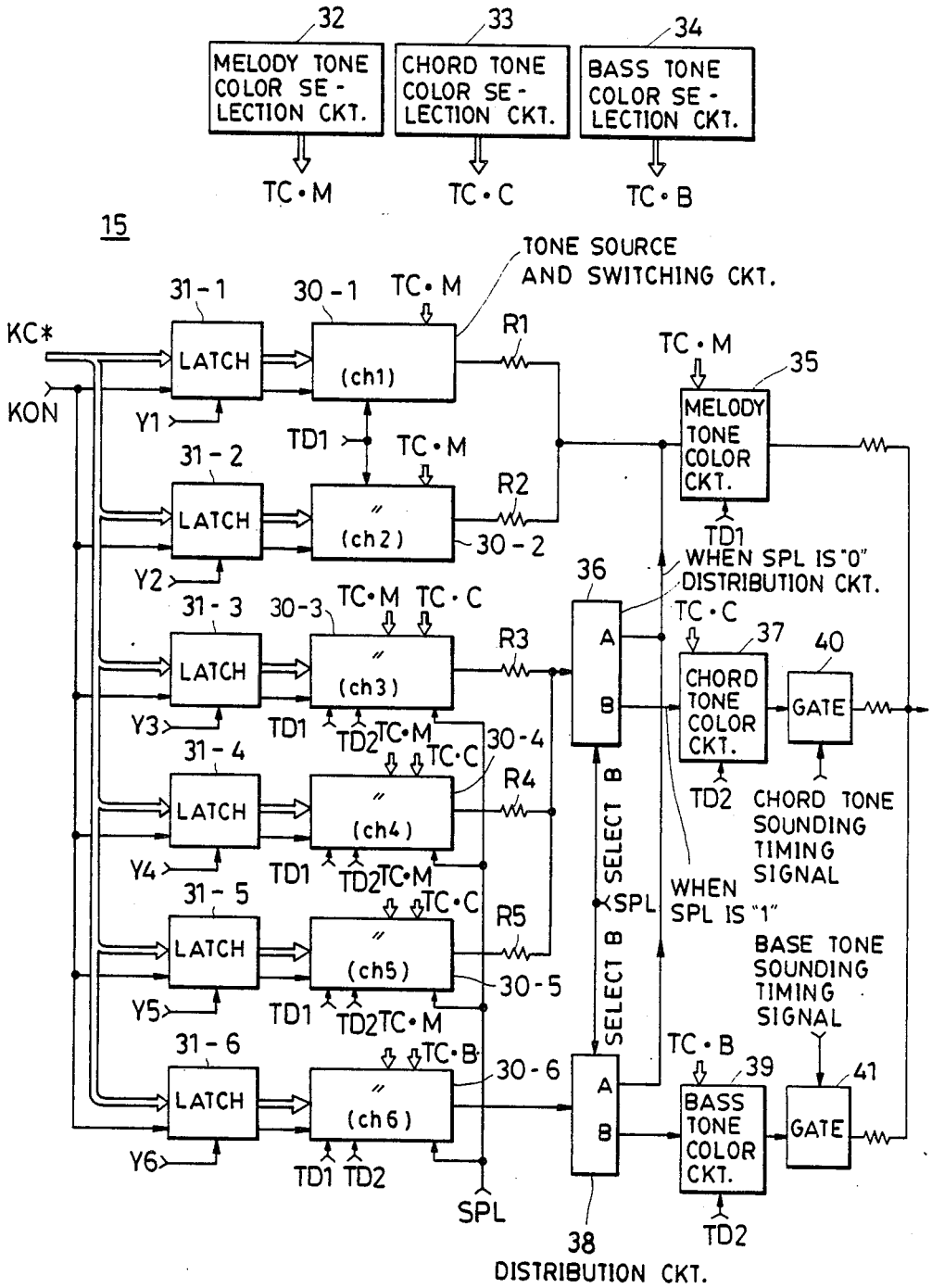
FIG. 3 is a block diagram showing an example of the tone forming circuit shown in FIG. 1.

The tone forming circuit 15 which forms tone signals in the different tone generation manners according to the key area split mode as described above can be constructed easily based on the known technique. FIG. 3 shows an example of the construction of the circuit 15, on which only a brief description will be made below as the tone forming circuit of such construction is described in the above-mentioned U.S. Pat. Nos. 4,365,532 and 4,450,745.

In the tone forming circuit 15 shown in FIG. 3, there are provided tone source and switching circuits 30-1 to 30-6 corresponding to N=6 channels (ch1 to ch6) disposed in parallel as tone forming means. The channel-wise key code KC* and key-on signal KON supplied in time division from the key assignor 20 are latched in latch circuits 31-1 to 31-6 corresponding to the channels, respectively. The latched key codes and the key-on signals are supplied to the corresponding tone source and switching circuits 30-1 to 30-6. Signals Y1 to Y6 for latch control are the timing signals synchronizing with the time division timings of said channels.

In this embodiment, since the first and the second channels (ch1 and ch2) are always used for the melody performance, the tone source and switching circuits 30-1 and 30-2 corresponding to these two channels are supplied with the output TC.M of a melody tone color selection circuit 32 and the touch signal TD1. These signals control the tone color and the touch response.

Since the third to fifth channels (ch3 to ch5) are used either for the melody performance or the chord performance according to the key area split mode, the tone source and switching circuits 30-3 to 30-5 corresponding to these channels are provided with the output TC.C of a chord tone color selection circuit 33, touch signal TD2 and the split mode signal SPL as well as the melody tone color selection output TC.M and the touch signal TD1 so as to effect either the tone control based on TC.M and TD1 or the tone control based on TC.C and TD2 according to whether the signal SPL is "0" or "1".

Since the sixth channel (ch6) is used either for the melody performance or the bass accompaniment according to the key area split mode, the corresponding tone source and switching circuit 30-6 is supplied with the output TC.B of a bass tone color selection circuit 34, touch signal TD2 and the split mode signal SPL as well as the melody tone color selection output TC.M and the touch signal TD1 so as to effect either the tone control based on TC.M and TD1 or the tone control based on TC.B and TD2 depending on whether the signal SPL is "0" or "1".

The outputs of the circuits 30-1 and 30-2 through resistors R1 and R2, respectively, are mixed and applied to a melody tone color circuit 35. The outputs of the circuits 30-3 to 30-5 through resistors R3 to R5, respectively, are mixed and applied to a distribution circuit 36. When the split mode signal SPL is "0", the mixed output through the resistors R3 to R5 is applied through the output A of the distribution circuit 36 to a melody tone color circuit 35 whereas when SPL is "1", said mixed output is applied through the output B to a chord tone color circuit 37. The output of the circuit 30-6 is applied to a distribution circuit 38 and, when the signal SPL is "0", supplied through the output A to the melody tone color circuit 35 and, when the signal SPL is "1", supplied through the output B to a bass tone color circuit 39. The tone color circuits 35, 37, and 39 are provided with the outputs TC.M, TC.C, and TC.B of the tone color selection circuits 32 to 34, respectively. The melody tone color circuit 35 is provided with the touch signal TD1 while the chord and bass tone color circuits 37 and 39 are provided with the touch signal TD2 so that the touch responsive control may be effected according to these touch signals. Gates 40 and 41 provided on the output side of the chord tone color circuit 37 and the bass tone color circuit 39, respectively, are controlled by the chord tone sounding timing signal and the bass tone sounding timing signal, respectively, so as to control the sounding timing automatically.

Figures 4, 5:
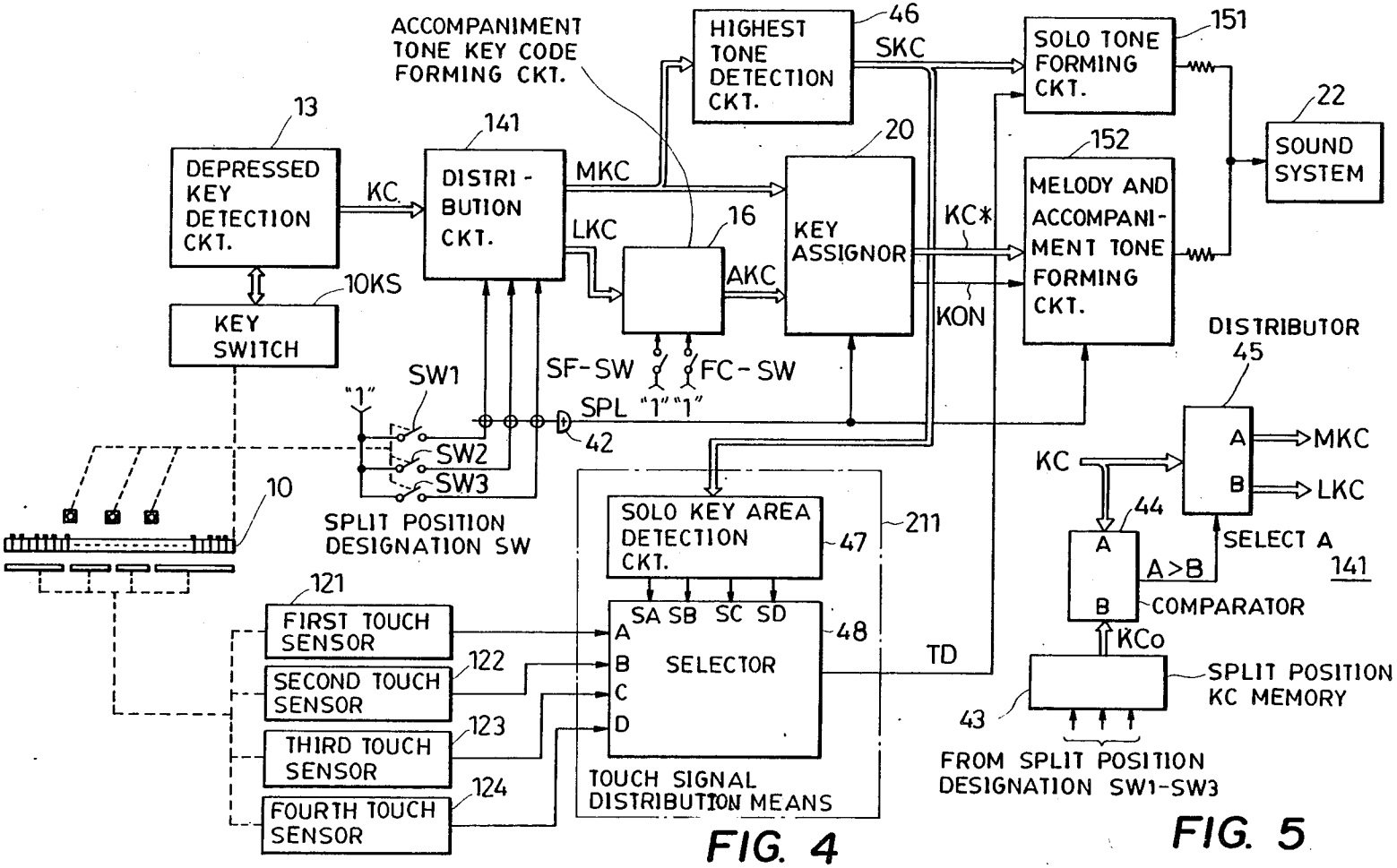
FIG. 4 is a block diagram showing another embodiment of the invention.
FIG. 5 is a block diagram showing an example of the distribution circuit shown in FIG. 5.

FIG. 4 shows another embodiment of the invention wherein the keyboard 10 has three split positions one of which is selected to split the keyboard into the higher key area and the lower key area. The touch responsive control is effected in the key area corresponding to the tone generation manner for the solo performance to be described below.

In respect of the four key areas into which the keyboard is split by the three split positions, there are provided first to fourth touch sensors 121 to 124, respectively, of which the outputs are applied to a touch signal distribution means 211. In respect of the three split positions there are provided split position designating switches SW1 to SW3 one (or none) of which is selectively turned on to select the key area split mode. The outputs of these switches SW1 to SW3 are applied to a distribution circuit 141 as well as to an OR gate 42. The output of the OR gate 42 is used as the split mode signal SPL similar to that in the above embodiment.

The switches and circuits designated by the same characters 10KS, 13, 16, 20, 22, SF-SW and FC-SW as those shown in FIG. 1 perform like functions. The distribution circuit 141 corresponding to the distribution circuit 14 shown in FIG. 1 splits the keyboard into the higher key area and the lower key area at the split position designated by one of the split position designation switches SW1 to SW3 and accordingly distributes the depressed key data, that is, the key code KC among the melody key code MKC and the lower key area key code LKC. FIG. 5 shows an example of the construction of the distribution circuit 141. The outputs of the switches SW1 to SW3 are applied to a split position key code memory 43 which reads out the key code $KC_0$ ($KC_0$ assumes three different values in response to SW1 to SW3) indicating the split position designated by the selected switch. A comparator 44 compares the depressed key code KC applied to the A input and said key code $KC_0$ applied to the B input and, when $A>B$, produces "1", causing a distributor 45 to select the A output and when $A \leqq B$, produces "0", causing the distributor 45 to select the B input. Consequently the key code KC belonging to the key area on the higher side of the split position selected is distributed as the melody key code MKC through the A output while the key code KC on the lower side of the split position selected is distributed through the B output as the lower key area key code LKC. When all the switches SW1 to SW3 are all off (that is, when in the normal mode), the key code $KC_0$ read out from the memory 43 has the value "0" so that the distributor 45 selects the A output at all times.

Reversing to FIG. 4, the embodiment shown is capable of performing the solo performance as well as the melody performance and the accompaniment performance. The solo performance is a performance effect whereby the tone corresponding to the highest of all the melody tones performed simultaneously is generated in a tone generation manner peculiar to the solo performance (with the tone color selected for the solo performance). In this embodiment, the touch responsive control is only effected on the solo performance tone. The melody key code MKC produced from the distribution circuit 141 is applied to a highest tone detection circuit 46 which selects the key code corresponding to the highest of one or more melody key codes corresponding to the keys depressed simultaneously and produces the key code it has thus selected as a solo key code SKC. A solo tone forming circuit 151 receives the solo key code SKC and forms the corresponding tone signal in the tone generation manner for the solo performance. At that time, the solo tone forming circuit 151 is supplied with the touch signal TD from a touch signal distribution means 211 so as to provide the solo performance tone with the touch response control according to the touch signal TD.

The touch signal distribution means 211 designates one or more key areas to be selected according to the outputs of the split position designating switches SW1 to SW3 and, based on the depressed key data of these key areas selects the outputs of the touch sensors 121 to 124 corresponding to the key areas to which the depressed key data belongs. Specifically, designation of one or more key areas to be selected according to the outputs of the switches SW1 to SW3 is carried out in the distribution circuit 141 so as to obtain the melody key code MKC as the depressed key data corresponding to the key area designated. From the melody key code MKC is selected the solo key code SKC by a highest tone detection circuit 46 and applied to a solo key area detection circuit 47 in a touch signal distribution means 211. Based on the value of the solo key code SKC, the solo key area detection circuit 47 determines which of the key areas respectively corresponding to the touch sensors 121 to 124 the key corresponding to said key code belongs. A selector 48 is supplied through its four inputs A to D with the outputs of the touch sensors 121 to 124, respectively, and selects one of these inputs A to D according to the output of the solo key area detection circuit 47. Thus one of the outputs of the touch sensors 121 to 124 corresponding to the key area to which the solo key code SKC corresponds is selected by the selector 48 and then supplied as the touch signal TD to a solo tone forming circuit 151.

A melody and accompaniment tone forming circuit 152 is substantially identical to the tone forming circuit 15 shown in FIG. 1 except that the former does not effect the touch responsive control. However, the embodiment shown in FIG. 4 may be provided with the same means as the touch signal distribution means 21 shown in FIG. 1 so that the touch response control may be also effected by the melody and accompaniment tone forming circuit 152.

While in the above embodiments, the automatic accompaniment function including automatic bass tone and automatic chord tone is used as the tone generation manner corresponding to the lower key area in the key area split mode, the automatic bass tone performance function may be omitted. Alternatively, the automatic accompaniment function may be totally omitted and the accompaniment (chord) may be performed manually. For that purpose, the accompaniment tone key code forming circuit 16 shown in FIGS. 1 and 4 is omitted.

Where the tone forming circuit is a digital circuit, the touch signals TD1, TD2 and TD as converted into digital signals may be supplied to the tone forming circuit or, alternatively, touch sensors which produce digital signals may be used.

While in the above embodiments, when the key area split mode is selected, the keyboard is split into two key areas, the higher and lower key areas, the keyboard may be split into more than two key areas. Further, there may be provided a plurality of key area split modes to provide a different number of split key areas (e.g., a first split mode providing two split key areas and a second split mode providing three split key areas).

Thus, according to the invention, there are provided a plurality of key touch detectors in respect of key areas separated by at least splittable positions and the outputs of the key touch detectors are selected according to the key area split mode selected by a switch and used as tone control signals. Therefore, the touch signal of the key area to which the depressed key belongs is selectively delivered so as to be used for the touch responsive control of the tone signal corresponding to the depressed key irrespective of the manner in which the key area split mode changes. Further, economy is achieved according to the invention in that each of the key touch detectors can be shared in the corresponding key area.

What is claimed is:

1. An electronic musical instrument comprising:

keyboard means having a key arrangement consisting of a plurality of keys arranged in a single line;

splitting means capable of selecting one among one or more key area split modes for splitting said keys into plural key areas at at least one predetermined position corresponding to a selected key area split mode in said key arrangement;

tone forming means connected to said keyboard means and said splitting means for forming a tone signal corresponding to a depressed key in a tone generation manner corresponding to said selected key area split mode;

touch detecting means including a plurality of key touch detection devices which is provided in association with said key areas respectively; and touch signal distribution means for distributing each of the outputs of said key touch detection devices in accordance with said selected key area split mode to supply it to said tone forming means as a tone control signal, and for using the output from one of said touch detecting devices to control the amplitude of the tones produced for all depressed keys when said keyboard is not split into plural key areas.

2. An electronic musical instrument as defined in claim 1 wherein said touch signal distribution means selectively takes out respective outputs of said key touch detection devices corresponding to said key areas in accordance with said selected key area split mode and supplies the taken out output signals to said tone forming circuit.

3. An electronic musical instrument as defined in claim 1 further comprises switching means for switching whether said keys should be split at one or more split positions or said keys should not be split at all and wherein said touch signal distribution means, when said plurality of keys is split, selectively takes out one of the outputs of said key touch detection devices corresponding to said key areas and supplies the taken out output signal to said tone forming means whereas, when said keys are not split, takes out all of the outputs of said key touch detection devices commonly and supplies these outputs to said tone forming means.

4. An electronic musical instrument as defined in claim 1 wherein said touch signal distribution means specifies one or more key areas to be selected in response to the output of said splitting means and selects one of the outputs of said key touch detection devices corresponding to a key area to which said depressed key belongs in accordance with key data of the depressed key in the specified key area or key areas.

5. An electronical musical instrument as defined in claim 1 wherein said touch signal distribution means selects, responsive to key data identifying the depressed key which belongs to a key area which is on the higher tone side or lower tone side of a split position specified by the output of said switching means, the output of one of said key touch detection devices corresponding to the key area to which the depressed key belongs and selectively applies the touch response control to a tone signal corresponding to said key area.

6. An electronic musical instrument comprising:

a keyboard having a key arrangement consisting of a plurality of keys arranged in a single line;

key touch detection devices respectively provided in association with said keys in said keyboard for producing a touch detection signal representing a key depression speed, a key depression force or a key depression depth of a depressed key;

selecting means for selecting use of the keyboard upon splitting said keyboard in plural key areas at at least one predetermined position in said key arrangement;

touch signal distribution means for distributing said touch detection signal in accordance with the key area to which said depressed key belongs, said key area being determined in response to the selection by said selecting means, and for using the output from one of said touch detection devices to control the amplitude of the tones produced for all depressed keys when said keyboard is not split into plural key areas; and tone forming means connected to said keyboard, said selecting means and said touch signal distribution means for forming a tone signal corresponding to said depressed key and controls said tone signal in response to said touch detection signal distributed in correspondence to the key area to which said depressed key belongs, said key area being determined in response to the selection by said selecting means.

7. An electronic musical instrument comprising:

keyboard means having a plurality of keys arranged in a single line, said keyboard means comprising:

a first keyboard section which includes at least one key among said plurality of keys and a second keyboard section which includes at least one key among said plurality of keys exclusive of the key or keys belonging to said first keyboard section;

key touch detecting means which comprises first detecting means and second detecting means, said first detecting means detecting a first key touch representing a degree of depression of a first key which is a depressed key on said first keyboard section and outputting a first touch signal representing said first key touch and said second detecting means detecting a second key touch representing a degree of depression of a second key which is a depressed key on said second keyboard section and outputting a second touch signal representing said first key touch;

tone signal forming means for forming a first tone signal having a pitch relating to said first key and having a touch responsive characteristic determined in accordance with said first touch signal and a second tone signal having a pitch relating to said second key and having a touch response characteristic determined in accordance with said second touch signal, said second tone signal being different from said first tone signal in tone quality; and mode selecting means for selecting either a first mode which is such a non-key split mode that tone signals corresponding to said plurality of keys are similar in tone quality based on which output of said first and second detecting means is greater, or a second mode which is such a key split mode that a plurality of keys are split into plural key groups and tone signals corresponding to keys in different key groups are different in tone quality.

8. An electronic musical instrument as defined in claim 7 wherein, said first or second key touch is one selected from the group consisting of a key depression speed, a key depression force and a key depression depth.

9. An electronic musical instrument as defined in claim 7 wherein, said second tone signal is a chord tone signal corresponding to chord constituting tones determined in accordance with said second key.

10. An electronic musical instrument as defined in claim 7 wherein, said second tone signal is a bass tone signal having a pitch determined by said second key.

11. An electronic musical instrument as defined in claim 7 which further comprises:

first inhibit means for inhibiting to impart said touch response characteristic determined in accordance with said first touch signal with said first tone signal.

12. An electronic musical instrument as defined in claim 7 which further comprises:

second inhibit means for inhibiting to impart said touch response characteristic determined in accordance with said second touch signal with said second tone signal.

13. An electronic musical instrument as defined in claim 7 wherein, said first keyboard section is adjacent to said second keyboard section, a key or keys on said first keyboard section being successive and a key or keys on said second keyboard section being successive.

14. An electronic musical instrument comprising:

keyboard means having a plurality of keys;

splitting means for providing one or more split position key codes for defining key areas on said keyboard as determined by the activation of one or more associated key split switches;

split position key code memory means for storing a plurality of key codes corresponding to plural potential key split positions defined by said key split switches;

scanner means for scanning all the keys of said keyboard and producing a key code for each depressed key; and comparator means for comparing each key code generated by said scanner means with said stored split position key codes and distributing each key code from said scanner means to a tone forming channel associated with the key area to which said key code belongs in accordance with the result of said comparison.

15. An electronic musical instrument comprising:

keyboard means having a plurality of keys;

a plurality of key detection means for detecting the depression of said keys;

a plurality of split position means for dividing said keyboard into a plurality of arbitrarily defined key areas; and touch signal distribution means operatively connected to said key detection means and said split position means for distributing the outputs from said key detection means to tone forming channels associated by virtue of the activation of said split position means with the key areas containing said depressed keys.

* * * * *